US006152245A

United States Patent [19]

Nilsson

[11] Patent Number: 6,152,245

[45] Date of Patent: Nov. 28, 2000

[54] COMPRESSED-AIR-OPERATED PERCUSSION MECHANISM

[76] Inventor: Göran Nilsson, Lötbacken, Sandarne, Sweden, S-820 22

[21] Appl. No.: 09/125,724

[22] PCT Filed: Mar. 4, 1997

[86] PCT No.: PCT/SE97/00359

§ 371 Date: Aug. 25, 1998

§ 102(e) Date: Aug. 25, 1998

[87] PCT Pub. No.: WO97/33723

PCT Pub. Date: Sep. 18, 1997

[30] Foreign Application Priority Data

Mar. 14, 1996 [SE] Sweden ..... 9600969

[51] Int. Cl.[7] ..... B25D 9/00

[52] U.S. Cl. ..... 173/218; 173/51; 173/121; 173/162.1; 173/204; 173/211; 173/212

[58] Field of Search ..... 173/218, 15, 17, 173/19, 51, 114, 202, 204, 210, 211, 212, 162.1, 206, 207, 121; 29/81.14; 91/50, 217

[56] References Cited

U.S. PATENT DOCUMENTS

| | | | |
|---|---|---|---|
| 3,680,643 | 8/1972 | Cameraon et al. | 173/51 |
| 4,117,764 | 10/1978 | Nilsson et al. | 91/50 |
| 4,351,225 | 9/1982 | Brandenberg et al. | 91/50 |
| 4,355,564 | 10/1982 | Gidlund | 91/217 |
| 4,605,073 | 8/1986 | Nilsson et al. | 173/51 |
| 4,609,054 | 9/1986 | Nilsson et al. | 173/202 |
| 4,681,172 | 7/1987 | Mikiya et al. | 173/162.1 |
| 4,723,610 | 2/1988 | Dummermuth et al. | 173/162.1 |
| 5,082,067 | 1/1992 | Tornqvist | 173/162.1 |
| 5,755,292 | 5/1998 | Nilsson et al. | 173/121 |

FOREIGN PATENT DOCUMENTS

| | | |
|---|---|---|
| 9203456 | 2/1995 | Sweden . |
| 9403729 | 5/1996 | Sweden . |
| 9411160 | 5/1994 | WIPO . |

*Primary Examiner*—Peter Vo
*Assistant Examiner*—Jim Calve
*Attorney, Agent, or Firm*—Young & Thompson

[57] ABSTRACT

A compressed-air-operated percussion mechanism includes a housing, a percussion body and a balancing body, which form an operating chamber therebetween. A secondary valve seals the operating chamber during an operating stroke and opens the chamber to evacuate compressed air after the termination of the operating stroke. A primary valve is connected to the compressed air inlet passage and intermittently opens to provide compressed air to the operating chamber.

3 Claims, 4 Drawing Sheets

COMPRESSED-AIR-OPERATED PERCUSSION MECHANISM

TECHNICAL FIELD OF THE INVENTION

This invention relates to a compressed-air-operated percussion mechanism including a housing and two bodies movable axially to-and-fro therein, i.e. a first body or percussion body and a second body or balancing body for the purpose of outbalancing the striking movements of the percussion body and thus de-vibrate the entire mechanism, an operating chamber defined between said bodies, an inlet passage emerging in said operating chamber for supplying compressed air, below called high-pressure air, to the chamber for the purpose of separating, against the action from spring means, the bodies from each other while executing an operating stroke, wherein compressed air of reduced pressure, below called low-pressure air, is evacuated from the operating chamber to at least one outlet during a return stroke, said supply of high-pressure air to the operating chamber being regulated by an intermittently opening, primary valve device.

Percussion mechanisms of this type are in practice used for devices of quite different types within quite different areas. As an example ram devices, hand tools for drilling, chiselling, engraving, hammering and surface treatment, devices for vibrating screens, feeding chutes and the like may be mentioned. An especially frequent field of use for the percussion mechanisms is as driving arrangements for chisel or needle scalers.

Since the percussion mechanisms require quick sequences of operation they are fed pneumatically, i.e. by compressed air.

PRIOR ART

A percussion mechanism of the type defined in the preamable is previously known in different versions from SE 9203456-0 and SE 9403729-8. In practice this known percussion mechanism operates with a primary valve device in the shape of a spigot connected with the percussion body, said spigot being movable through a through-going hole in an end wall of the balancing body. The spigot has on one hand a thin shank and on the other hand a thickened end portion having a diameter corresponding wits the diameter of the hole in the end wall. When the percussion and balancing bodies are approached to each other and the operating chamber has a minimal volume, the high-pressure air in an inlet passage in the balancing body is allowed to flow into the operating chamber in order to initiate the operating stroke. When the bodies are distanced from each other to a certain degree the thickened end portion of the spigot is however entered into the hole in the end wall and seals said hole, whereby further supply of compressed air to the operating chamber is made impossible. Thus the operating stroke is terminated and during a return stroke the bodies are again approaching each other. This valve device is thus principally serving as an air flow limiter having primarily the purpose of reducing the consumption of compressed air.

A disadvantage of the device known from SE 9203456-0 and SE 9403729-8 is that the percussion body and its working element, e.g. a scaler or a set of needles, achieve a limited length of stroke. Another disadvantage is that the pressure in the operating chamber decreases towards the end of each operating stroke. This means that the working element during the end phase of the individual operating strokes is acting with a limited force only.

OBJECTS AND FEATURES OF THE INVENTION

The present invention aims at overcome the disadvantages mentioned above and create an improved percussion mechanism. A primary object of the invention is thus to create a percussion mechanism that can be designed with an arbitrary length of stroke at the same time as the consumption of compressed air is kept at a minimum level, i.e. by cutting off the supply of compressed air to the operating chamber during the main part of each return stroke. Another object is to create a percussion mechanism that manages to operate with one and the same high air pressure during the entire operating stroke, i.e. without a pressure reduction at the end of each operating stroke.

According to the invention at least the primary object is attained by means of the features defined in the characterizing clause of claim 1. Preferred embodiments of the invention are further defined in the dependent claims.

BRIEF DESCRIPTION OF THE APPENDED DRAWINGS

In the drawings:

FIG. 1 is a partial longitudinal section through a needle scaler including a percussion mechanism according to the invention, said mechanism being shown in a state when the operating chamber has a minimum volume, more precisely immediately before the performance of an operating stroke, FIG. 2 is a corresponding longitudinal section showing the percussion mechanism in a state after the performing of an operating stroke, said operating chamber having a maximum volume, FIG. 3 is an enlarged portion of the percussion mechanism in the state according to FIG. 1, FIG. 4 is an enlarged portion of the percussion mechanism in the state according to FIG. 2, FIG. 5 is a partial longitudinal section through an alternative embodiment of the invention, said percussion mechanism being shown in a state immediately before an operating stroke is initiated, FIG. 6 is a corresponding longitudinal section showing the same mechanism immediately after the performing of an operating stroke, FIG. 7 is a partial longitudinal section through a regulating mechanism for the supply of compressed air to a needle scaler according to previous figures, a regulating button located in an outer, closing end position being shown influenced by compressed air, and FIG. 8 is a longitudinal section showing the same mechanism having the regulating button pushed-in to open a compressed air passage.

DETAILED DESCRIPTION OF THE EMBODIMENT ACCORDING TO FIGS. 1–4

Figure 1:
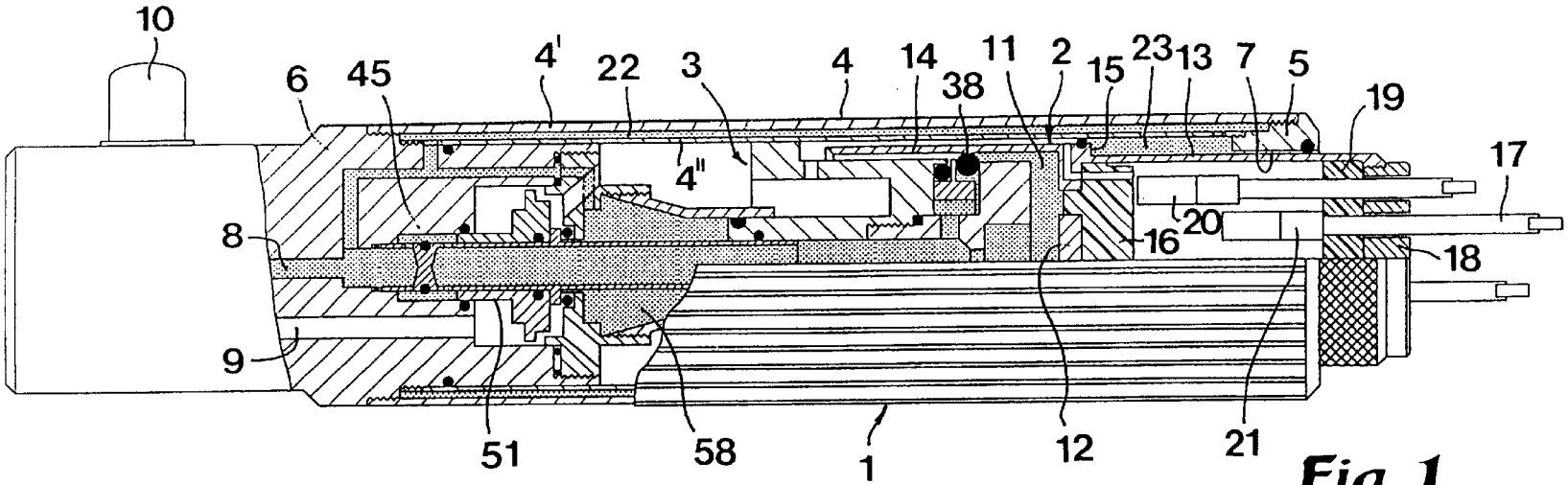

In FIGS. 1–4 a percussion mechanism included in a pneumatically operated needle scaler is illustrated, said mechanism including a housing generally designated by 1 and two bodies being axially movable to-and-fro therein, said bodies being generally designated 2 and 3 respectively. The housing 1 is composed of a cylindrical tube 4 and two end pieces connected to opposite ends thereof, i.e. a front end piece 5 and a rear end piece 6. The front end piece 5 is in the form of a ring having a central opening 7. An outer portion of the body 2 extends through said opening 7, said body 2 being named percussion body. In the rear end piece 6 there are two passages 8, 9, the first mentioned passage forming an inlet or a feed passage for supplying compressed air to the percussion mechanism. This compressed air is named high-pressure air and is in the drawings illustrated by close dots. The second passage 9 forms an evacuation passage through which compressed air of reduced pressure, below named low-pressure air, may be led out into the open. A regulating mechanism that cooperates with the inlet passage 8 includes a push button 10, that in an outer end position cuts off the supply of high-pressure air to the passage 8 and in a pressed-in position opens said passage.

The second body 3 forms a balancing body having the function of outbalancing the percussion or impact movements of the percussion body and thus de-vibrate the whole mechanism. Between the percussion and balancing bodies 2, 3 an operating chamber is defined, said chamber being designated 11.

For examplifying purposes it should be mentioned that the high-pressure air may have a pressure of 6 kg/cm$^2$ above atmospheric pressure, while the low-pressure air may have a pressure within the range of 0.1–1.5 kg/cm$^2$ above atmospheric pressure, i.e. a certain overpressure in relation to atmospheric pressure.

As far as the illustrated percussion mechanism is described it is essentially previously known from e.g. SE 9203456-0 and SE 9403729-8 respectively.

The percussion body 2 includes a frame in the shape of a transverse wall 12 and two tubular, cylindrical members 13, 14 that projects from opposite sides of the frame wall. The first, front tubular member 13 has a smaller diameter than the tubular member 14, whereby a shoulder 15 is provided between said members. A disc 16 of plastic, e.g. polyuretan, or another elastic material, is connected with the frame wall 12 that is made out of metal. Said disc 16 forms a contact surface for a number of rod-shaped or bar-shaped needle elements 17 that are movable through holes in a front wall 18 mounted on the free end of the tubular member 13. On the inner side of this front wall 18 a second disc 19 of plastic, e.g. polyuretan, or another elastic material, is provided. The needle elements 17 are made out of metal, e.g. steel, and have a head 20 at their rear ends. In the area in front of each head 20 a sleeve 21 of plastic, e.g. polyuretan, or another elastic material, is provided. When the mechanism performs an operating stroke the percussion body 2 is moved to the right in FIGS. 1 and 2 and the disc 16 drives all needle elements. At a distance from the disc 19 the needle elements leave the disc 16 and the tips of the needle elements will be thrown against the object that is to be worked. During the return stroke the needle elements are returned to their initial position by driving of the front wall 18 and the disc 19.

The housing 1 is double-walled in the sense that the cylindrical wall 4 includes two concentric part walls 4', 4" that are separated by a thin annular or cylindrical gap 22.

In order to bring the percussion- and balancing bodies 2, 3 to be returned towards each other after an operating stroke, spring means are necessary for each body. Said spring means may consist of mechanical compression springs or gas springs. In the embodiment disclosed in FIGS. 1–4 the percussion body 2 is affected by a gas spring in the shape of an air cushion in a space 23 that is defined between the tubular members 4" and 13 as well as the shoulder 15 and the end wall 5. This air cushion space 23 is sealed by means of O-rings 24, 25 and communicates with the passage-forming annular gap 22 via a small radial hole 26 in the tubular wall 4". At its opposite end the annular gap 22 communicates with the inlet passage 8 for high-pressure air via a secondary main passage 27 and a first branch passage 28. High-pressure air from the inlet passage 8 is thus supplied continuously to the gas spring space 23.

Figure 3:
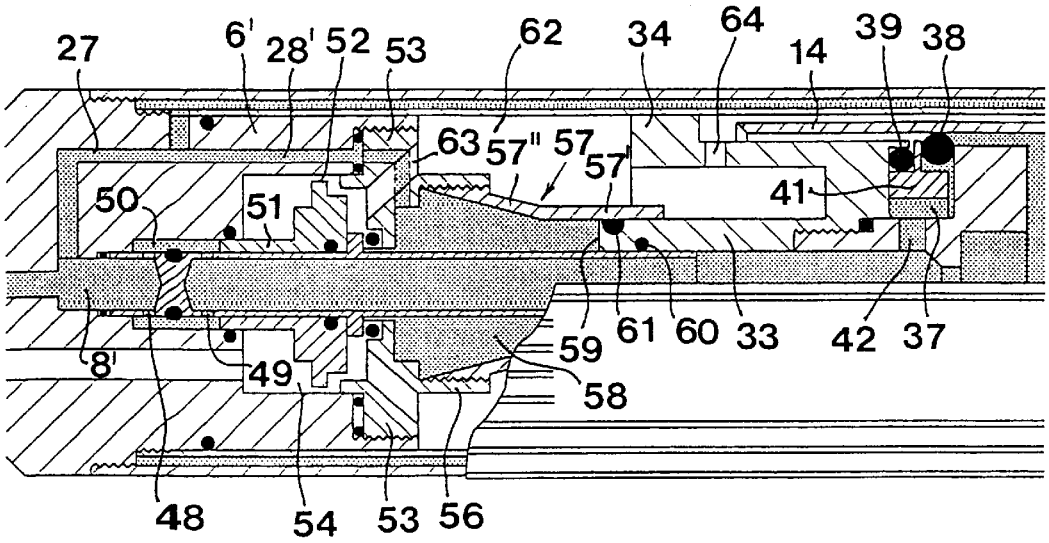
Figure 4:
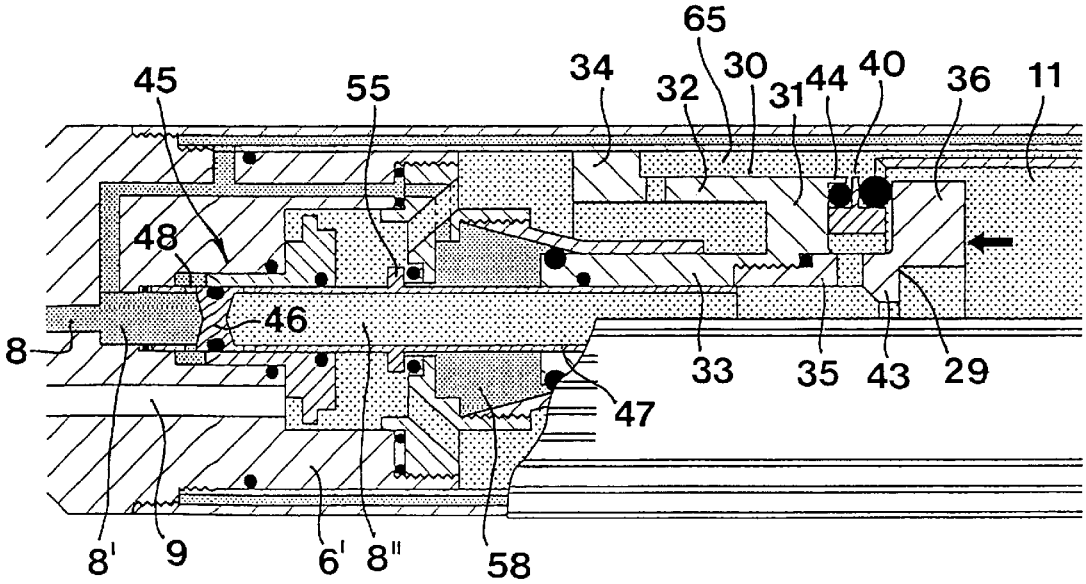

Reference is now made to FIGS. 3 and 4 which on an enlarged scale illustrate the structural design of the balancing body 3. The balancing body is composed of two main elements 29, 30 that are connected with each other via a threaded coupling and an O-ring. The main element 30 includes a frame flange and two rearwardly from said flange projecting tubular or cylindrical members 32, 33, the first one of which has an end flange 34 serving as a bearing surface for the balancing body. The other main element 29 includes a cylindrical member 35 and a frame flange 36. The length of the cylindrical member 35 is such that between the frame flanges 31, 36 an annular space 37 (see FIG. 3) is formed that emerges in the envelope surface of the balancing body. In this annular space 37 a secondary valve device is provided, said valve device including two O-rings 38, 39 having different diameters. Said O-rings are located on each side of a dividing flange 40 formed on the external side of a ring 41 having a slightly smaller width that the annular space 37. Further, the ring 41 has an internal diameter that is larger than the external diameter of the cylindrical member 35. In the cylindrical member 35 a radial hole 42 is recessed. Downstream of said hole 42, on the internal side of the central bore through the cylindrical member 35, an annular peak or bulge 43 is formed, said bulge 43 serving as a restriction for the high-pressure air in the inlet passage. The dividing flange 40 has a slightly larger external diameter than the frame flange 36. It should also be noticed that the frame flange 31 has a forwardly projecting stop flange 44 that keeps the O-ring 39 in place. The O-ring 38 forms a secondary valve device, the function of which will be described more in detail below.

According to a characteristic feature of the invention a primary valve device, generally designated by 45, is provided at a distance from the operating chamber 11 and the two bodies 2, 3 that define said chamber. In the disclosed, preferred embodiment said primary valve includes a dividing wall 46 that separates first and second sections 8', 8" of the inlet passage 8. More precisely the dividing wall 46 is provided inside a tube 47 that surrounds the passage section 8" and projects into a central bore in the balancing body 3. On both sides of the dividing wall 46 radial holes 48, 49 are recessed, said holes emerging in an annular or cylindrical gap space 50 that forms a by-pass passage between the passage sections 8', 8". A valve element in the shape of a sleeve 51 is accommodated in the annular space 50. The sleeve is axially movable to-and-fro in the annular gap and has a driving flange 52 at its front end. The external diameter of said driving flange is only slightly smaller than the internal diameter of the surrounding cylindrical portion 6' of the end piece 6. The cylindrical portion 6' defines together with a transverse wall 53 a space designated by 54, the driving flange 52 of the sleeve being movable to-and-fro in said space 54. An outer end position for the valve sleeve is defined by a stop flange 55 on the outer side of the tube 47. It should be noted that the valve sleeve is sealed by a number of O-rings that not have been given reference numerals due to space-saving reasons.

At the front side of the frame or end wall 53 an internally threaded tubular fitting 56 is provided, said fitting 56 serving as seat for a tubular member generally designated by 57, said tubular member 57 including on one hand a cylindrical external portion 57' and on the other hand a conical portion 57". Said tubular member 57 defines a space 58 for receiving high-pressure air via a branch passage 28' that communicates with the inlet passage 8 via the secondary main passage 27. The high-pressure air in this space 58 forms an air cushion or gas spring for the balancing body 3. More precisely, this air cushion will act against an end surface 59 of the cylindrical member 33 of the balancing body that projects into the cylindrical portion 57' of the tubular member 57. The cylindrical member 33 is sealed on one hand relative to the tube 47 via an internal O-ring 60 and on the other hand relative to the cylindrical portion 57' of the tubular member 57 via an external O-ring 61. Said O-ring 61 is compressed as long as it is located along the axial area that is defined by the cylindrical portion 57', but as soon as the O-ring 61 enters the conical space that is defined by the conical tubular portion 57" it will expand. This means that the force that acts upon the rear end of the cylindrical member 33 will increase when the end surface 59 and the O-ring 61 enters the conical space since the surface that is affected by the high-pressure air in the space 58 will increase to the same extent as the O-ring 61 expands. In other words the balancing body will be affected by an increasing pressure force when it approaches a rear end position when the O-ring 61 has entered the space 58.

It should further be noticed that the space 54 communicates with a space 62 via a hole 63, said space 62 surrounding the tubular member 57. Although shown in the same level in the drawings of FIGS. 3 and 4, said hole 63 is tangentially separated from the branch passage 28' that supplies high-pressure air to the space 58.

It should also be noticed that the space 62 communicates with a space 65 via a radial hole 64, said space 65 surrounding the balancing body.

The function of the Percussion Mechanism According to the Invention

In FIGS. 1 and 3 the mechanism is shown in a neutral position between an operating stroke and a return stroke, more precisely in a state where the operating chamber 11 has a minimal volume and when an operating stroke is to be initiated. In this state the primary valve device 45 is open since the valve sleeve 51 is displaced to an outer, forward end position. The sleeve assumes this end position by affection from the high-pressure air in the by-pass passage 50. The two radial holes 48, 49 are open in order to allow the high-pressure air to pass from the passage section 8' to the passage section 8" via the by-pass passage 50. From the passage section 8" high-pressure air can thus pass freely in direction towards the operating chamber 11. Before the high-pressure air reaches the operating chamber it will meet the restriction bulge 43 that takes care of a deflection of the air flow to the annular space 37, more precisely via the radial holes 42. When the air flows into the annular space and passes both sides of the ring 41 the O-ring 39 that contacts the stop flange 44 will become compressed and thus wider. This means that the ring 41 has a tendency to be displaced to the right on the drawing and the dividing flange 40 of the ring 41 will compress the other O-ring 38 in such a way that it seals relative to surrounding surfaces simultaneously as it is brought to expand as a consequence of the pressure in the annular space. The result is that the O-ring 38 is urged against the internal side of the cylindrical member 14 and seals relative said member. When this sealing effect is achieved by means of the two o-rings 38, 39 that together form the secondary valve device, compressed air of full pressure rushes further into the operating chamber. This in turn has the result that the balancing body 3 as well as the percussion body 2 are subjected to pressure forces that bring the bodies to separate, more precisely against the action of the gas springs in the spaces 23, 58. In other words an operating stroke is initiated and during said operating stroke the balancing body 3 moves to the left towards a rear end position at the same time as the percussion body 2 moves to the right towards a forward end position. These end positions are shown in FIGS. 2 and 4 that illustrate a state where the operating chamber 11 has a maximum volume.

Figure 2:
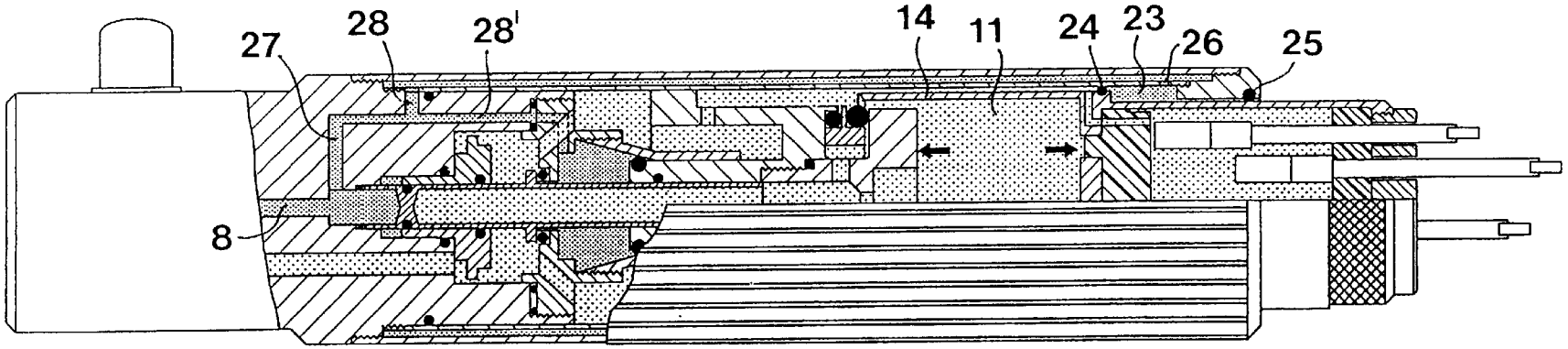

In the neutral position according to FIG. 2, when a return stroke is to be initiated, the needle elements 17 are projecting to an essentially maximum degree simultaneously as the balancing body 3 is located in a rear end position.

When the O-ring 38 at the end of the operating stroke leaves the free end of the cylindrical member 14 the sealing relative said member is terminated and by its internal resilience the O-ring is contracted and gets into contact with the ring 41. Hereby, the operating chamber 11 is opened and consequently the pressure in said chamber decreases. In other words low-pressure air will rush out of the operating chamber. Said low-pressure air is returned via the space 65, the holes 64, the space 62 and the holes 63 to the space 54 where the valve sleeve 51 is located. When the low-pressure air (that still has a certain over-pressure compared to atmospheric pressure) rushes into the space 54 said air will affect the driving flange 52 of the sleeve. Due to the fact that this flange has an external diameter that is only slightly smaller than the internal diameter of the surrounding portion 6' of the end piece 6 only a smaller amount of air will initially pass between the periphery of the flange and the surrounding cylindrical portion 6'. As a consequence of the fact that the driving flange 52 has an essentially larger active pressure surface than the comparatively diminutive pressure surface that is formed by the end surface of the sleeve 51, the force that is exerted upon the driving flange will overcome the force that the high-pressure medium in the by-pass passage exerts upon the sleeve. This means that the sleeve is pushed to its rear end position, shown in FIGS. 2 and 4, where the sleeve closes the radial holes 49. In other words the communication between the two sections 8', 8" of the inlet passage is cut off and the supply of high-pressure air in direction towards the operating chamber ceases.

Also at the end of the operating stroke, when the operating chamber opens, the gas springs in the spaces 23 and 58 are active due to the fact that these spaces always communicate with the input section 8' of the inlet passage 8. The pressure of the gas springs therefore, in a given point, effects a turning of the percussion and balancing bodies, more precisely by exerting a successively increasing force upon these bodies after the opening of the operating chamber. When the balancing bodies have reached their outer end positions they are thus brought to return in direction towards each other while initiating a return stroke. In this connection it should be pointed out that low-pressure air in the space 54 will flow out into the return passage 9 as soon as the valve sleeve reaches its rear, closing end position. Therefore,when the return stroke starts the low-pressure air no longer exerts such a large force upon the valve sleeve that it is able to maintain the valve sleeve in closing position. In other words the force generated by the high-pressure air in the by-pass passage takes over and displaces the valve sleeve to the right. This means that the by-pass passage opens again for high-pressure air to flow from the section 8' to the section 8". High-pressure air thus flows again in direction towards the operating chamber and the described course is repeated.

The Benefits of the Invention

Due to the fact that the intermittently opening, primary valve device 45 that regulates the supply of high-pressure air to the operating chamber is located at a distance from the operating chamber and has no physical connection with the operating chamber and the percussion and balancing bodies respectively, the percussion mechanism may be designed with an arbitrary length of the stroke. Another benefit is that one and the same high pressure may be upheld in the operating chamber during the entire operating stroke. Thus the primary valve device is open regardless of how far the percussion and balancing bodies move away from each other. Not until the operating chamber is opened by the O-ring 38 leaving the cylindrical member 14 of the percussion body, the primary valve device is closed and cuts off the supply of high-pressure air to the operating chamber. Another benefit of using gas springs is that gas from the outside need not to be supplied since the gas springs always communicate with the continuously pressurized section of the inlet passage.

Figure 5:
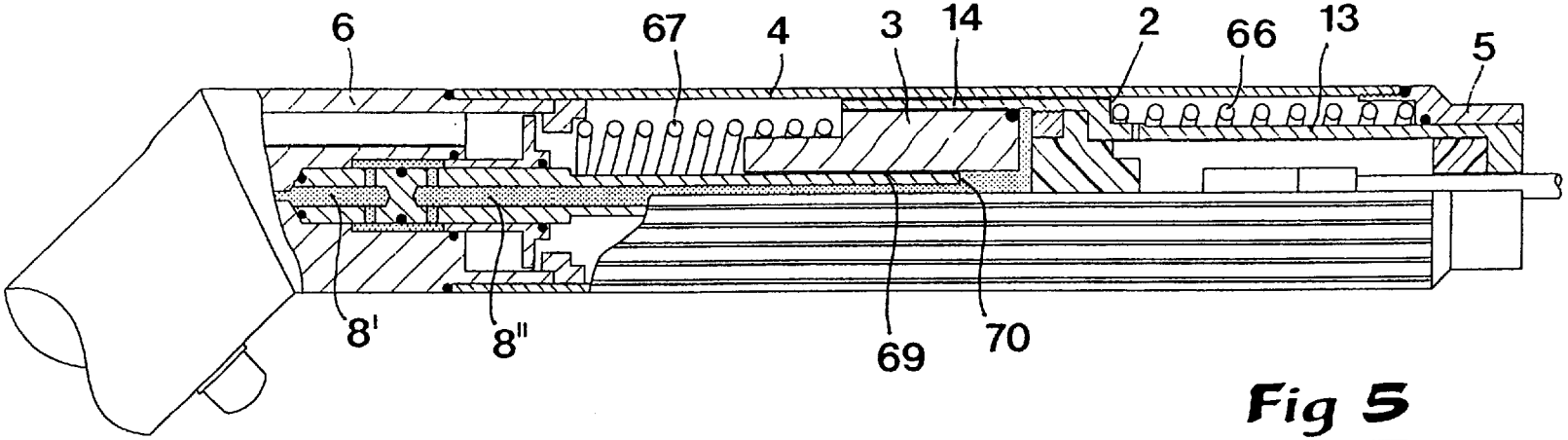
Figure 6:
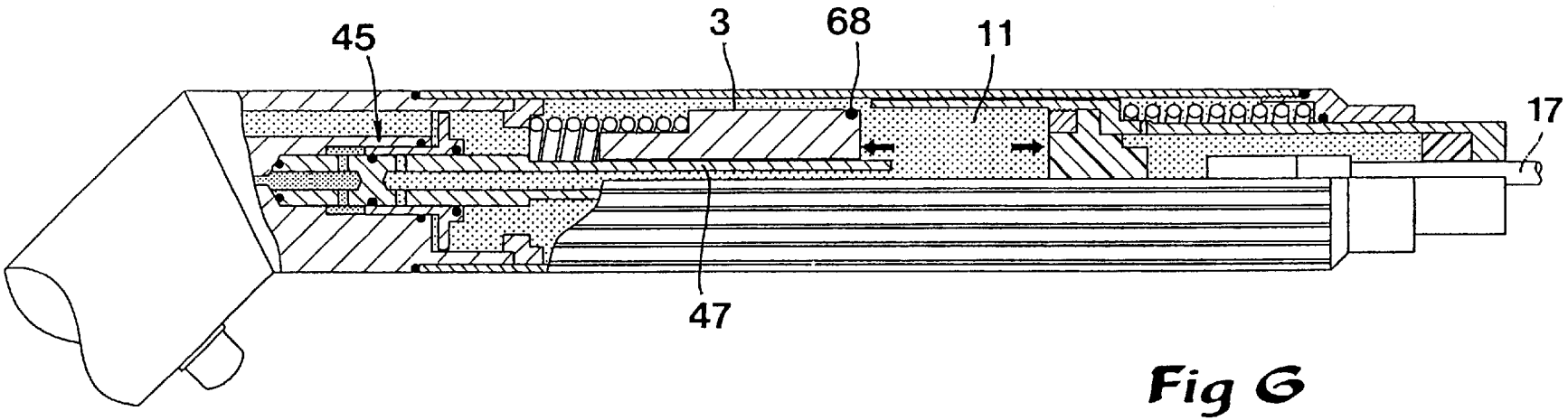

Brief Description of the Embodiment According to FIGS. 5 and 6

Reference is now made to FIGS. 5–6 that illustrate an alternative, simplified embodiment that is especially suitable to operate at relatively low air pressures. As for the previous embodiment the mechanism includes percussion and balancing bodies 2, 3 and a primary valve device 45 of principally the same type as the previously shown. The percussion body 2 is provided to act upon one single operating element 17, e.g. in the shape of a shank of a chisel. Instead of gas springs two pressure springs 66, 67 are used in this case, more precisely coil pressure springs. Another modification compared to the embodiment according to FIGS. 1–4 is that the secondary valve device is considerably simplified. In this case said valve device consists of a simple O-ring 68 in the envelope surface of the cylindrical balancing body as well as an utterly narrow and elongated air gap 69 between the external side of the tube 47 and the internal side of the through-going bore through the balancing body. In practice this gap extends along the entire balancing body and has a radial depth within the range of 0.1–0.3 mm, preferably about 0.2 mm.

In FIG. 5 the mechanism is shown in a state when an operating stroke is to be initiated. Therefore, the primary valve device 45 is open and allows high-pressure air to flow towards the operating chamber. As a consequence of the fact that this high-pressure air at a high velocity by-passes the forward, free edge 70 of the tube 47, simultaneously as the gap 69 is extremely narrow, an ejector action is created in the gap, said ejector action having as a result that air in the gap is sucked rather towards the operating chamber than the other way around. In other words the high-pressure air is prevented from entering the gap, meaning that the gap seals, at least during such a long time that the forward end of the balancing body has passed the edge 70 and acquired such a high velocity that the internal energy in the balancing body is at its maximum.

Figure 7:
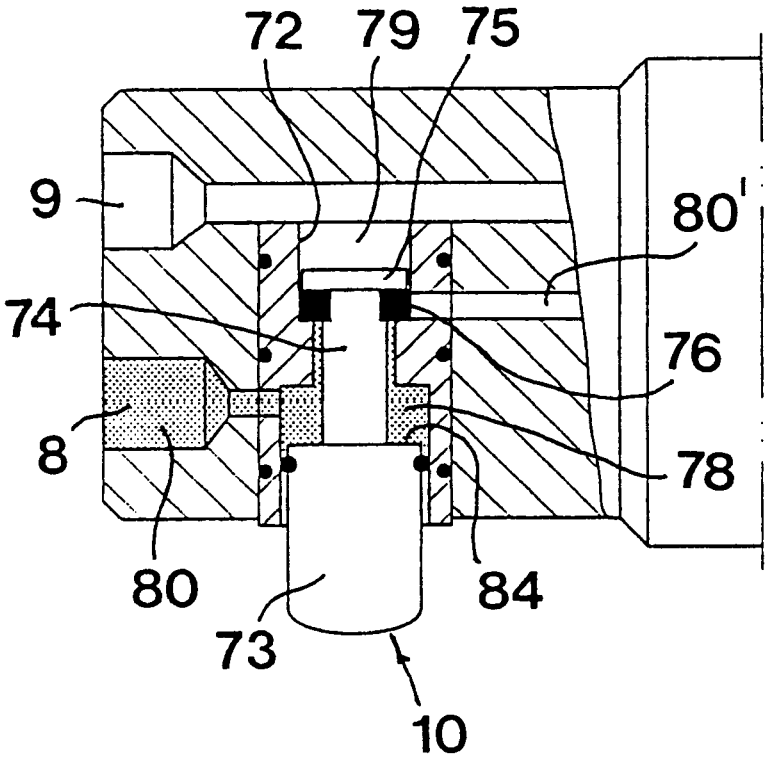
Figure 8:
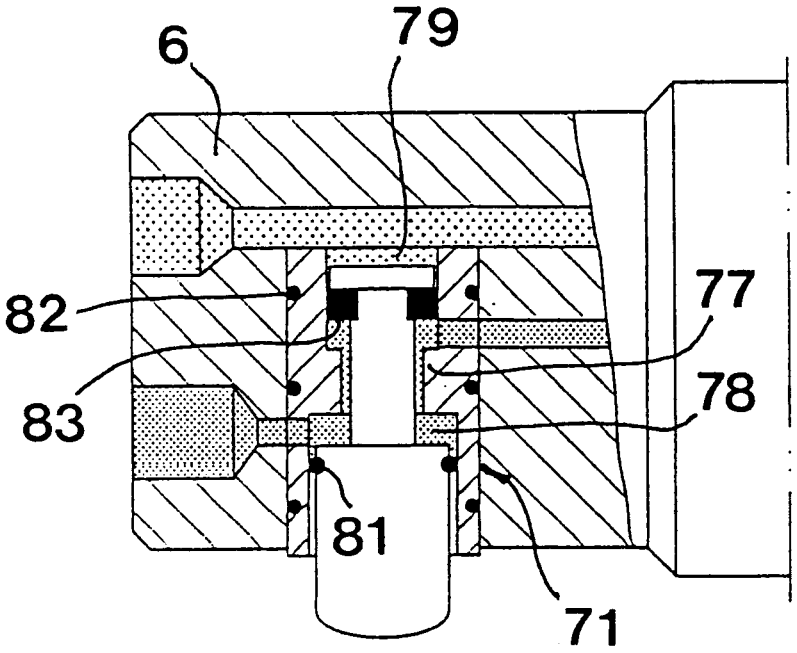

Detailed Description of the Regulating Mechanism According to FIGS. 7 and 8

In FIGS. 7 and 8 a mechanism to regulate the supply of compressed air to the percussion mechanism described above is shown.

Likewise conventional regulating mechanisms for this purpose the disclosed mechanism includes a pressure device that is movable to-and-fro in a bore recessed in a fitting, whereby input and output sections of the compressed air passage emerge in said bore, and that the pressure device normally is kept in an outer end position where the passage is cut off, said pressure device being kept in said end position by an outwardly directed pressure force. Against the action of said pressure force it is possible to push the pressure device manually inwardly to an inner position where the passage is opened.

In conventional, previously known regulating mechanisms a mechanical pressure spring, e.g. a coil pressure spring, has the function to normally keep the pressure device in the outer position where the passage is cut off. When the operator opens the mechanism the pressure device must be kept continuously pushed inwardly against the action of the spring during the entire time as supply of compressed air is desired. These open-keeping times are not seldom long, e.g. sequences of several minutes or more. Since the spring must have a considerable spring strength in order to guarantee effective cutting off of the flow of compressed air, the operation to maintain the pressure device pushed inwardly becomes ergonomically tough. Tendencies of exhaustion and tensions in the finger that keeps the pressure device pushed inwardly will in practice have the result that the supply of compressed air will be cut off too soon.

The present regulating mechanism aims to overcome the drawbacks of previously known regulating mechanisms.

In the drawing the previously described inlet and outlet passages in the end piece 6 are still designated by 8 and 9 respectively. The button serving as a pressure device is generally designated by 10. In this case the fitting in which the pressure device is movable is in the shape of a sleeve 71 having an internal, essentially cylindrical bore 72. The pressure device 10 includes an outer, relatively thick head 73 and a slimmer shank 74 that at its end pointing from the head 73 has a transverse flange 75. On the external side of this flange a sealing ring 76 is provided, e.g. a rubber ring adhered to the flange, said rubber ring having a square shape in cross-section.

At the internal side of the sleeve 71 an annular shoulder 77 is provided that divides an outer space 78 from an inner space 79 having a slightly smaller cross-section area or diameter than the space 78. In the space 78 an input section, designated by 80, of the inlet passage 8 emerges while an output passage section 80' emerges at the opposite side of the shoulder 77, i.e. in the inner space 79. The essentially cylindrical head 73 is sealed relative to the sleeve 71 by at least one sealing ring 81, e.g. an O-ring. It should also be noticed that the fitting sleeve 71 at its external side is sealed relative to surrounding parts of the end piece 6 by means of three axially separated sealing rings 82.

The external side of the transverse flange 75, or in the example, the external side of the sealing ring 76 mounted on the flange 75, forms a first pressure surface 83. An analogous second pressure surface 84 is formed by the internal side of the head 73. The last-mentioned pressure surface is somewhat larger than the first pressure surface 83.

In FIG. 7 the mechanism is shown in a closing state, i.e. in the input passage section 79 the compressed air acts upon the pressure surface 84 while a first pressure force is subjected upon the pressure device. This first pressure force maintains the pressure device in an outer end position where the sealing ring 76 is urged towards the internal side of the shoulder 77 while cutting off each communication with the input and output passage sections 80, 80'. Said first pressure force is comparatively large. When connection with the output passage section 80' is to be established the pressure device is pushed inwards against the action of the first pressure force to the position that is shown in FIG. 8. Due to the fact that the shank 74 has a smaller diameter than the bore through the annular shoulder 77, compressed air is now allowed to flow from the passage section 79 to the passage section 80. The compressed air will thereby also act upon the pressure surface 83 and subject a second pressure force upon the pressure device, said second force having an opposite direction compared to the first one. As a consequence of the fact that the pressure surface 83 is designed only slightly smaller than the pressure surface 84, the resulting force that still strives to displace the pressure device towards its outer position is comparatively small. After the pressure device initially has been pushed inwardly against the action of a comparatively large pressure force, said pressure device may be kept in a pushed-in position by a comparatively small force. However, said small force is quite sufficient to return the pressure device to the closing starting position as soon as the operator gives the pressure device free.

Possible Modifications of the Invention

The invention is not restricted to the percussion mechanisms shown in FIGS. 1–6. Thus it is possible to use, instead of either two mechanical springs or two gas springs, on one hand a gas spring and on the other hand a mechanical spring for the return strokes of the percussion and balancing bodies. Further, the structural design of the primary valve device as well as the secondary valve device may vary quite considerably within the scope of the appending claim 1. By varying the characteristics of the springs the percussion mechanism according to the invention may in practice be designed for quite different application areas.

What is claimed is:

1. A pneumatic percussion mechanism comprising:

a housing;

a percussion body axially movable within the housing;

a collar member extending from the percussion body;

a balancing body having a cylindrical element with a radial hole therein, the cylindrical element being axially movable within the collar member to form an annular space therebetween;

an operating chamber defined by the percussion body and the balancing body;

means for urging the percussion body and the balancing body toward one another;

a compressed air inlet passage connected to the operating chamber, so as to cause the percussion body and the balancing body to move away from one another;

an O-ring surrounding the cylindrical element, the O-ring being positioned in an annular recess on the cylindrical element so that during a first portion of a stroke of the balancing body, the O-ring is contained within the collar member, and during a second portion of the stroke of the balancing body, the O-ring is not within the collar member; and an intermittently opening, primary valve device connected to the compressed air inlet passage to control a flow of the compressed air to the operating chamber;

wherein when the compressed air is being supplied to the operating chamber and the balancing body is in the first portion of the stroke, the O-ring is expanded from a relaxed position by pressure of the compressed air provided though the radial hole in the cylindrical element to seal against an interior of the collar member, and when the balancing body is in the second portion of the stroke, the O-ring returns to the relaxed position and the compressed air is allowed to escape from the operating chamber thought the annular space; and wherein a maximum operational separation distance between the percussion body and the balancing body is defined by the position of the O-ring with respect to the collar member.

2. Percussion mechanism according to claim 1, wherein the primary valve device (45) includes at least two axially separated, radial holes (48, 49) through which the compressed air may flow radially between on one hand a by-pass passage (50) common for both said radial holes and on the other hand each of first and second passage sections (8', 8") of the inlet passage (8), the primary valve device comprising an axially to-and-fro movable slide element (51) that in a first end position keeps both of the radial holes (48, 49) open and thus allows the compressed air to flow from the first passage section (8') to the second passage section (8"), via the by-pass passage (50), and in an opposite second end position closes at least one of the radial holes and thus makes it impossible for the compressed air to flow from the first passage section to the second passage section.

3. Percussion mechanism according to claim 2, wherein the first passage section (8') of the inlet passage (8) is separated from the second passage section (8") by a partition (46) provided in the inlet passage, the by-pass passage comprising an annular or cylindrical gap (50) that is concentric with the inlet passage (8), the radial holes (48, 49) located on both sides of the partition (46) emerging in said gap (50), the slide element comprising a sleeve (51) movable in said annular gap, said sleeve (51) having a flange (52) at a free end, said flange (52) being possible to actuate by low-pressure air flowing out of the operating chamber (11).

* * * * *